US008905119B2

(12) United States Patent
Chandia et al.

(10) Patent No.: US 8,905,119 B2
(45) Date of Patent: Dec. 9, 2014

(54) CASTING EQUIPMENT STARTER BLOCK

(75) Inventors: Muhammad Umar Farooq Chandia, Sunndalsøra (NO); Harald Næss, Jr., Grøa (NO); Geir Atle Røen, Kvanne (NO)

(73) Assignee: Norsk Hydro ASA, Olso (NO)

( * ) Notice: Subject to any disclaimer, the term of this patent is extended or adjusted under 35 U.S.C. 154(b) by 0 days.

(21) Appl. No.: 13/878,283

(22) PCT Filed: Oct. 17, 2011

(86) PCT No.: PCT/NO2011/000293

§ 371 (c)(1),
(2), (4) Date: Jun. 4, 2013

(87) PCT Pub. No.: WO2012/053896

PCT Pub. Date: Apr. 26, 2012

(65) Prior Publication Data

US 2013/0255904 A1 Oct. 3, 2013

(30) Foreign Application Priority Data

Oct. 18, 2010 (NO) ..... 20101443

(51) Int. Cl.
*B22D 11/08* (2006.01)

(52) U.S. Cl.
CPC ..... *B22D 11/083* (2013.01); *B22D 11/081* (2013.01)
USPC ..... 164/425; 164/426; 164/436; 164/445; 164/446; 164/491

(58) Field of Classification Search
CPC ..... B22D 11/081; B22D 11/083; B22D 11/05
USPC ..... 164/425, 426, 436, 445, 446, 491
See application file for complete search history.

(56) References Cited

U.S. PATENT DOCUMENTS 3,847,206 A * 11/1974 Foye ..... 164/425
5,634,511 A 6/1997 Steen et al.

(Continued)

FOREIGN PATENT DOCUMENTS

WO 95/10376 4/1995

OTHER PUBLICATIONS

Definition of automatically, http://dictionary.reference.com/browse/automatically, 1998.*

(Continued)

*Primary Examiner* — Kevin E Yoon
(74) *Attorney, Agent, or Firm* — Wenderoth, Lind & Ponack, LLP

(57) ABSTRACT

Equipment for the semi-continuous direct chill (DC) casting of sheet ingot or slabs of different dimensions, in particular for rolling purposes. The equipment includes a mold frame (2) with a pair of facing long side walls (3) and a pair of facing short end walls (4) where the walls define an upwardly open inlet for the supply of metal and a downwardly facing outlet. The outlet is provided with a starter block (6) on a movable support, which prior to each casting, closes the opening. The equipment includes a device for changing the mold dimensions where at least one end wall can be displaced to enable casting of different size ingots. The equipment further includes an arrangement for indirect and direct cooling of the metal during casting. The starter block is provided with short end walls (11) and long side walls (9). At least one short end wall is movable relative to the mold.

10 Claims, 4 Drawing Sheets

Area A of Fig. 1:

(56) References Cited

U.S. PATENT DOCUMENTS

| | | | | |
|---|---|---|---|---|
| 6,056,040 | A | 5/2000 | Weaver et al. | |
| 8,561,669 | B2 * | 10/2013 | Næss et al. | 164/436 |
| 2004/0055732 | A1 | 3/2004 | LeBlanc et al. | |

OTHER PUBLICATIONS

International Search Report issued Jan. 12, 2012 in International (PCT) Application No. PCT/NO2011/000293.

* cited by examiner

CASTING EQUIPMENT STARTER BLOCK

BACKGROUND OF THE INVENTION

1. Field of the Invention

The present invention relates to equipment for the semi-continuous direct chill (DC) casting of sheet ingot or slabs of aluminium of different dimensions, in particular ingot or slabs for rolling thin sheet material, including a mold frame with a pair of facing side walls and a pair of facing end walls, the walls defining a mold with an upwardly open inlet for the supply of metal and a downwardly facing outlet provided with a starter block on a movable support which prior to each casting closes the downwardly facing opening and where at least one side wall and/or one end wall can be displaced to enable casting of ingots with different dimensions. The equipment further including means for cooling the metal and optionally means for flexing the mold to compensate for shrinkage.

2. Description of the Related Art

When casting large rectangular-section ingots to be used in the production of rolled products, it is customary to impart a small amount of convex curvature to the long side walls of the mold to counteract the greater metal shrinkage (pull-in) which takes place near the middle of the wide side faces of the ingot during solidification as compared with locations near the narrow end faces of the ingot. The shrinkage (pull-in) of the metal is proportional to the extension of the non-frozen metal in the ingot after casting conditions are stabilized. During the casting of large ingots the extension of molten metal in the lengthways direction of the ingot (the sump depth) may be up to 0.8 meter or more depending on the size of the ingot.

It is primarily the casting speed that influences the extension of the mushy zone, because it is the thermal conductivity of the material that limits the cooling speed in the middle of the ingot. The amount of water that is jetted onto the ingot surface on the underside of the mold represents a cooling capacity that goes beyond the amount of heat that is transferred to the surface by heat conduction.

With regard to both metallurgy and productivity it is desirable to apply the highest casting speed possible. The casting speed is normally limited by the tendency of hot crack formation in the ingot being cast when the speed is too high.

In the initial stage of a casting operation the cooling will be slow and there will be a contraction in the ingot being cast caused by the difference in specific density between the melted and the frozen metal, together with the thermal coefficient of expansion. The metal that initially has frozen will be of a somewhat reduced shape in relation to the geometry of the casting mold. Because of the above-mentioned curvature of the widest faces of the casting mold, the ingot being cast will assume a convex shape in the initial stage of the casting operation. The convexity will gradually reduce until stable conditions with respect to the sump dept in the ingot being cast are stabilized.

The operating manual of a rolling mill specifies that the rolling surfaces should be straight (without any concavity or convexity in the rolling surfaces). To meet this requirement the casting molds have to be designed with a curvature (flexing) of the side walls corresponding to the estimated shrinkage/contraction of the ingot to be cast.

The applicants own EP 0 796 683 B1 relates to equipment for the casting of sheet ingot of the above kind where the side walls are adapted for flexing and are further provided with a stiffening part at their middle region to obtain controlled stiffness and thereby optimal flexure of the mold walls versus the casting speed. This known solution is, however, not designed for casting ingots with different dimensions (size).

When casting ingots or slabs for rolling purposes, which are in the form of large metal blocks with rectangular cross sections, it is normal to employ a special mold for each ingot width and thickness. Mainly because of the close dimensional tolerances required, it is complicated and expensive to produce continuous casting molds. As many different ingot formats are required, it is necessary but uneconomical to keep a corresponding large number of molds in store. Besides, replacing a mold of one dimension with another mold with different dimension is demanding and time consuming.

U.S. Pat. No. 5,931,216 relates to adjustable continuous casting molds for manufacturing continuously cast ingots of different dimensions where the object is to provide an adjustable mold which provides rapid change to the required ingot cross section based on the one and same mold. An important disadvantage with this solution is that the shape of the mold has no means to compensate for casting speed or change of dimension of the mold having in turn bad effect on ingot geometry. Further, this known mold is based on using starter blocks with fixed dimension and design.

In the applicants own International application PCT/NO/09/00309 is shown and described a mold where the disadvantages with the above known solutions are avoided, i.e. where the walls of the mold can be easily adjusted from one dimension to another casting sheet ingots with different dimensions and where at the same time flexing of the walls is possible to compensate for different speeds as well as dimension and alloy composition. However, to change to the desired mold dimension, the starter block is provided with replaceable end pieces on each of its short end sides. This solution is time consuming because the replaceable pieces need to be taken off or added to the short end sides depending on which dimension the mold is adjusted to.

BRIEF SUMMARY OF THE INVENTION

With the present invention is provided a simple and inexpensive starter block solution where the dimension of the starter block is self adjusting and automatically adapts to the selected size of the mold.

BRIEF DESCRIPTION OF THE DRAWINGS

The present invention will be described in further detail in the following by means of examples and with reference to the drawings, where.

DETAILED DESCRIPTION OF THE INVENTION

The initial starting point for the basic design of the starter block according to the present invention is a mold technology solution for sheet ingot which combines both flexing and dimension adjustments of the same mold as described in the applicants own International patent application PCT/NO/09/00309. The flexible mold principle was invented to obtain the requirements on geometry, while at the same time the adjustable mold principle was chosen to reduce the cost of casting when going from one ingot dimension to another dimension.

The most common dimensions for sheet ingot for rolling are based on 600 mm standard thickness with varying width from 1550-1850 mm and with 50 mm steps. Other dimensions may also occur such as 1950-2200 mm and with 50 mm steps.

Figure 1:
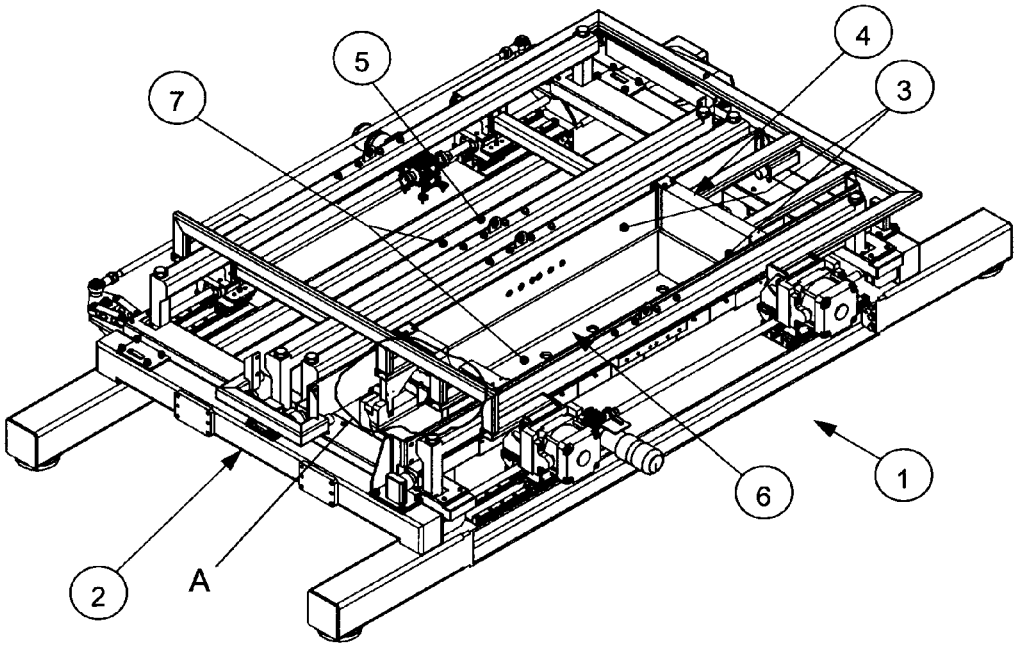
FIG. 1 shows in perspective, partly from above and in the longitudinal direction, a schematic view of the casting equipment with the starter block according to the present invention.

FIG. 1 shows, as stated above, equipment 1 for the semi-continuous direct chill (DC) casting of sheet ingot or slabs of different dimensions, in particular for rolling, requiring large ingots with rectangular cross sections of the above-mentioned kind. The equipment, as shown in FIG. 1, comprises two molds 7 provided in parallel in a frame construction 2, each mold 7 including a pair of facing side walls 3 and a pair of facing end walls 4. The walls 3 and 4 define a mold cavity 5 with an upwardly open inlet for the supply of metal and a downwardly facing outlet provided with a starter block 6 according to the invention connected to a movable support (not shown in the figures) and which, prior to each casting sequence, closes the downwardly facing opening. The equipment further includes means for cooling the metal comprising supply means for water and water jet nozzles (not further shown) arranged in the lower part of the walls 3, 4 along the periphery of the mold 7 (not further shown).

Figure 2:
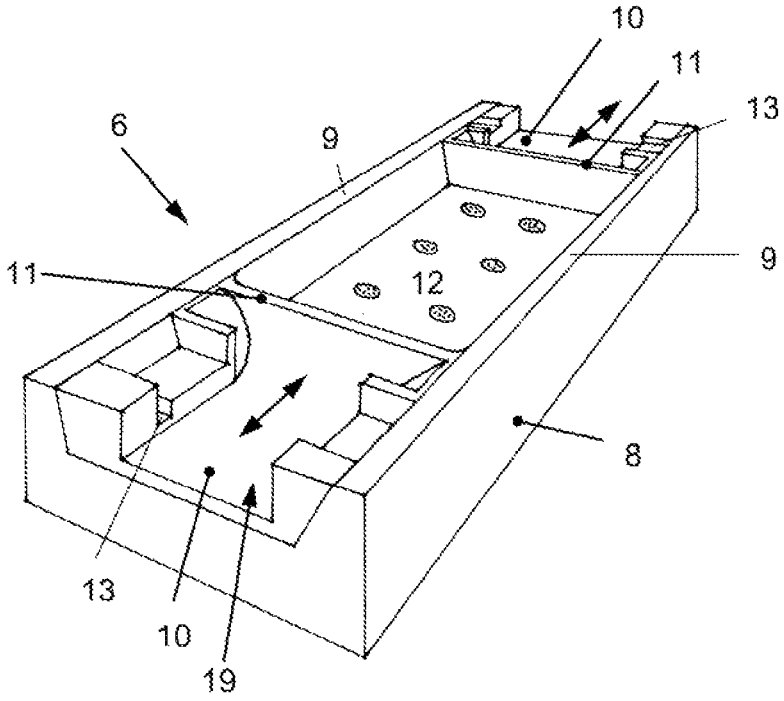
FIG. 2 shows in perspective the starter block as shown in FIG. 1 taken alone i.e. shown as an individual item.
Figure 3:
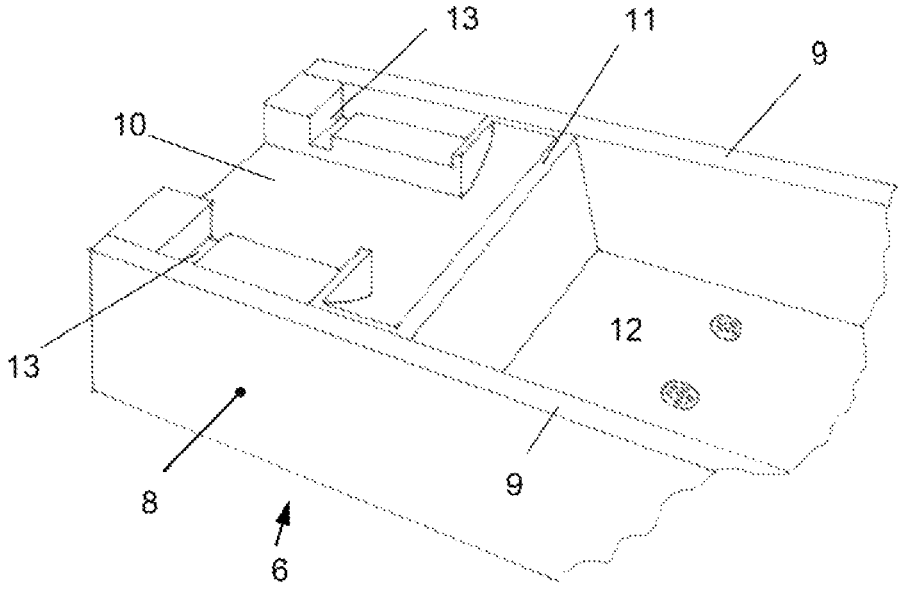
FIG. 3 also shows in perspective only a left hand side of the starter block shown in FIGS. 1 and 2, but shown partly in the opposite direction.

FIGS. 2 and 3 show solely the starter block 6 as such, taken out of FIG. 1 to see the design and details of it somewhat better. The starter block 6 is made of metal, preferably aluminium, and includes a base piece 8 with longitudinal, upwardly protruding long side walls 9 and within the side walls movably provided end pieces 10 with short end walls 11. Each of the end pieces with the short end walls 11 can easily be moved inwardly or outwardly and can thereby be adjusted to the desired ingot dimension prior to casting. The end pieces fit tightly within the "channel" or recess 12 formed between the long side walls 9 of the starter block so that there is no leakage between the end piece 10 and base piece 8 when liquid metal is filled into the starter block and casting is started. If required a suitable seal may be provided between the end piece and base piece of the starter block.

As is shown in FIGS. 2, 3, 4 and 5, each of the end pieces 10 is provided with recesses 13, one on each side, designed as a female part to interact with a male carrier bracket 14 (shown only in FIGS. 4 and 5) provided in conjunction with the short end side 4 of the mold 7. The carrier brackets 14 are attached to the short end sides 4 by screws 15 or the like (see FIG. 4) and are thereby moved with the short end sides when adjusting the short end sides to the desired ingot dimension. The purpose of the male 14 and female 13 arrangements is to automatically move the end piece 10 to the desired position prior to each casting operation which will be further described in the following with reference to the sequence diagrams shown in FIG. 5.

For the sake of simplicity, only the end piece 10 with the recess 13, the base piece 8 and the carrier bracket 14 with the short end side 4 of the mold on the left hand side of the casting equipment are shown in the sequence diagrams.

Figure 5:
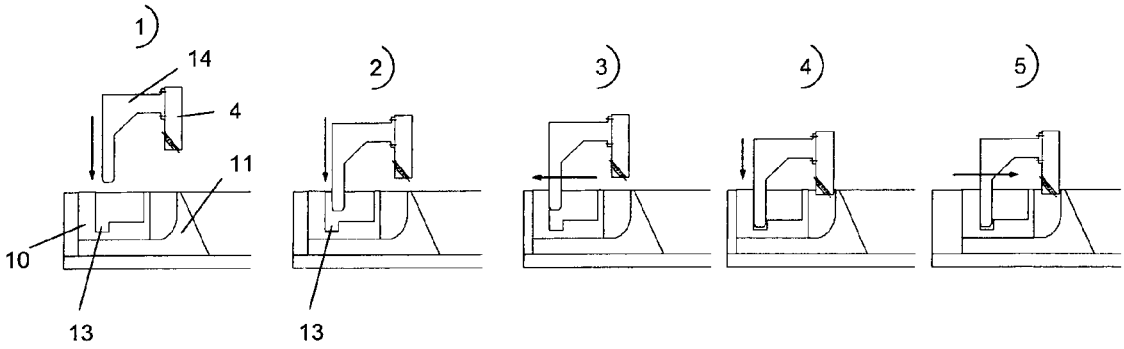
FIG. 5 shows sequence diagrams of the interaction of a carrier bracket and end piece of the starter block relating to the adjustment of the starter block to the selected ingot size.

Sequence 1) of FIG. 5 shows the initial starting point for the casting mold 7 with the short end side 4 and carrier bracket 14 prior to casting. The starter block 6 with the end piece 10 is provided just below the mold 7. The starter block 6 is then, as shown in sequence 2), moved upwards such that the bracket 14 enters the recess 13 in the end piece 10. The short end side 4 is now moved outwards by a driving means (not shown) to its outer position at which the mold is at its largest dimension. At the same time the carrier bracket 14 abuts the recess 13 moving the end piece 10 to its outer position as shown in sequence 3). The short end wall 4 of the mold is now in alignment with the short end wall 11 of the end piece 10, and the starter block 6 is moved upwards to its desired starting position prior to casting as shown in sequence 4). Finally, as illustrated in sequence 5), the short end wall 4 of the mold together with the end piece 10 is moved inwards to the desired dimension for casting and the casting operation may start. The above sequence shows the alignment and adjustment of the short end walls 4, 11 of the mold and the starter block provided on the left hand side of the mold. The same alignment and adjustment is simultaneously performed with the short end walls 4, 11 on the right hand side of the casting equipment.

Figure 4:
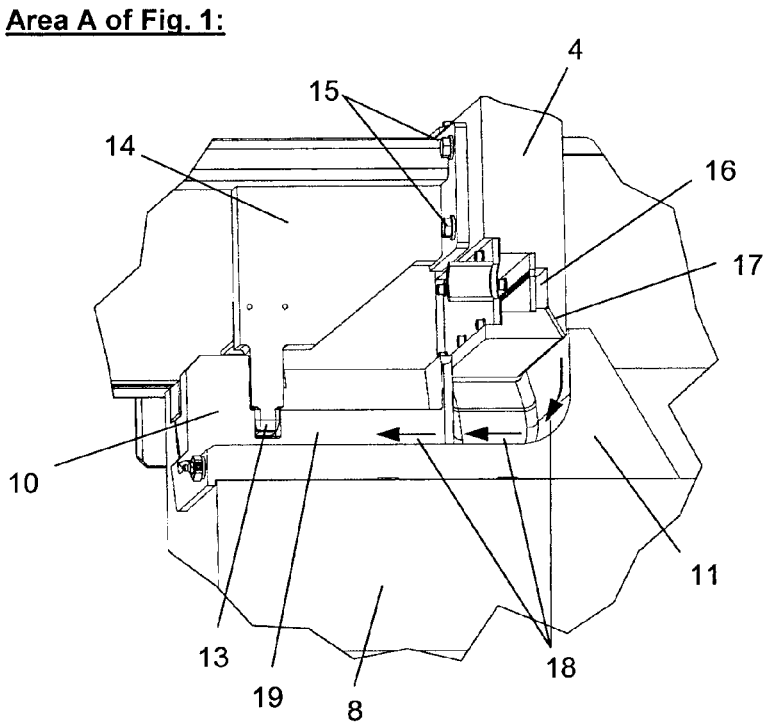
FIG. 4 shows in larger scale and in perspective part of the starter block at the short end side denoted A in FIG. 1.

During casting of a sheet ingot, water is required for cooling and is sprayed directly (direct chill, DC) onto the cast metal as it emerges downwards. As to the end pieces 10, it is of the outmost importance that there is no leakage of water into the cavity 12 of starter block prior to or in the initial casting phase, as such leakage could cause an explosion and serious damage. FIG. 4 shows, in larger scale and in perspective, part of starter block at the short end side denoted A in FIG. 1. The short end side 4 of the mold is provided with supply means for water including a channel 16 with water spray nozzles 17. To avoid leakage into the mold and starter block, each of the end pieces 10 is designed such that in the starting position the water is sprayed on the outside of the end wall 11 at a point below the top of the wall 11 and the water is directed outwards from and led away from the wall in a passage 19 in direction of the arrows 18 of the end piece 10 (also see FIG. 2).

The starter block according to the invention may preferably, as stated above, be made of aluminium, but other suitable materials such as steel or refractory material may also be used.

To reduce friction between the end pieces 10 and the base piece 8, each of the end pieces (10) may be provided with a self lubricating bronze or carbon layer. However, other means such as grease or other suitable lubricant may also be supplied to or provided between the interacting surfaces of the end pieces and the starter block base piece 8.

The invention claimed is:

1. Equipment for the semi-continuous direct chill casting of sheet ingot or slabs of different dimensions, the equipment including:

a mold frame having a pair of facing long side walls and a pair of facing short end walls, the long side walls and the short end walls defining an upwardly open inlet for the supply of metal and a downwardly facing outlet, wherein at least one of the short end walls can be displaced to enable casting of ingots or slabs of different sizes; and a starter block disposed on a movable support and provided at the downwardly facing outlet, the starter block including a pair of short end walls and a pair of long side walls, wherein at least one of the short end walls of the starter block is movable relative to the long side walls of the mold frame, and thereby may be adjusted to a selected ingot mold dimension prior to casting, wherein the starter block includes a base piece and opposing end pieces, wherein the base piece defines the long side walls of the starter block, and the opposing end pieces are movably disposed between the long side walls of the starter block, and wherein the short end walls of the starter block are connected to the end pieces, respectively, so that the end pieces with the short end walls of the starter block may be adjusted to the selected ingot mold dimension prior to casting.

2. The equipment according to claim 1, wherein the at least one short end wall of the starter block is automatically adjusted to a size corresponding to the selected ingot mold dimension.

3. The equipment according to claim 1, wherein each of the end pieces is provided with two recesses, one on each side of the end piece, for receiving a male carrier bracket connected to the at least one short end wall of the mold frame such that the at least one of the short end walls of the starter block interacts with and is adjusted simultaneously with an adjustment of the at least one short end wall of the mold frame.

4. The equipment according to claim 1, wherein each of the short end walls of the mold frame is provided with water jet nozzles, and each of the end pieces is designed such that in a starting position prior to casting, water can be sprayed on an outside of the short end walls of the starter block at a point below a top of the short end walls of the starter block, and each of the end pieces includes a passage for directing water outwards and away from the short end walls of the starter block.

5. The equipment according to claim 1, wherein the starter block is made of aluminum.

6. The equipment according to claim 1, wherein each of the end pieces is provided with a self-lubricating bronze or carbon layer to reduce friction between the end pieces and base piece.

7. The equipment according to claim 1, wherein the end pieces of the starter block are engaged with the short end walls of the mold frame such that the position of the at least one short end wall of the starter block is adjusted simultaneously with displacement of the at least one short end wall of the mold frame.

8. Equipment for the semi-continuous direct chill casting of sheet ingot or slabs of different dimensions, the equipment including:

a mold frame having a pair of facing long side walls and a pair of facing short end walls, the long side walls and the short end walls defining an upwardly open inlet for the supply of metal and a downwardly facing outlet, wherein at least one of the short end walls can be displaced to enable casting of ingots or slabs of different sizes; and a starter block disposed on a movable support and provided at the downwardly facing outlet, the starter block including a base piece and a pair of opposing end pieces forming short end walls, the base piece defining longitudinally extending side walls that project upwardly to define a channel, wherein the end pieces are movably disposed in the channel formed by the longitudinally extending side walls, and the end pieces of the starter block are engageable with members projecting from the short end walls of the mold frame so that the end pieces of the starter block are automatically positioned in response to an adjustment of the short end walls of the mold frame prior to casting.

9. The equipment according to claim 8, wherein each of the end pieces are provided with recesses for receiving the members projecting from the short end walls of the mold frame, respectively.

10. The equipment according to claim 9, wherein the members projecting from the short end walls of the mold frame comprise male carrier brackets attached to the short ends walls of the mold frame.

* * * * *